US006453665B1

(12) United States Patent
Bower, Jr. et al.

(10) Patent No.: US 6,453,665 B1
(45) Date of Patent: Sep. 24, 2002

(54) CATALYST BASED ADAPTIVE FUEL CONTROL

(75) Inventors: Stanley L. Bower, Jr., Ann Arbor, MI (US); Donald J. Lewis, Brighton, MI (US); Kevin Ronald Carlstrom, Fort Wayne, IN (US); Stephen L. Hahn, Novi, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/560,736

(22) Filed: Apr. 28, 2000

(51) Int. Cl.[7] ..... F01N 3/00

(52) U.S. Cl. ..... 60/285; 60/274; 60/276; 60/277

(58) Field of Search ..... 60/274, 276, 285, 60/277

(56) References Cited

U.S. PATENT DOCUMENTS

| | | | | | |
|---|---|---|---|---|---|
| 5,077,970 | A | * | 1/1992 | Hamburg | 60/274 |
| 5,255,512 | A | | 10/1993 | Hamburg et al. | |
| 5,282,360 | A | | 2/1994 | Hamburg et al. | |
| 5,293,740 | A | * | 3/1994 | Heppner et al. | 60/285 |
| 5,341,643 | A | * | 8/1994 | Hamburg et al. | 60/277 |
| 5,359,852 | A | | 11/1994 | Curran et al. | |
| 5,473,889 | A | * | 12/1995 | Ehard et al. | 60/285 |
| 5,483,946 | A | * | 1/1996 | Hamburg et al. | 60/284 |
| 5,537,816 | A | * | 7/1996 | Ridgway et al. | 60/285 |
| 5,584,176 | A | * | 12/1996 | Meyer et al. | 60/277 |
| 5,615,550 | A | * | 4/1997 | Ogawa et al. | 60/285 |
| 5,617,722 | A | * | 4/1997 | Takaku | 60/277 |
| 5,653,104 | A | * | 8/1997 | Hamburg et al. | 60/285 |
| 5,758,490 | A | * | 6/1998 | Maki et al. | 60/274 |
| 5,784,880 | A | | 7/1998 | Toshiro et al. | |
| 5,848,528 | A | | 12/1998 | Liu | |
| 5,857,163 | A | | 1/1999 | Trombley et al. | |
| 5,881,552 | A | | 3/1999 | Iwata et al. | |
| 5,894,724 | A | | 4/1999 | Minowa et al. | |
| 5,946,905 | A | * | 9/1999 | Bouwman | 60/285 |
| 6,003,308 | A | * | 12/1999 | Tsutsumi et al. | 60/277 |
| 6,073,073 | A | * | 6/2000 | Kitamura et al. | 60/285 |
| 6,076,348 | A | * | 6/2000 | Falandino et al. | 60/277 |
| 6,151,888 | A | * | 11/2000 | Schneider et al. | 60/277 |
| 6,253,542 | B1 | * | 7/2001 | Omara et al. | 60/285 |
| 6,256,981 | B1 | * | 7/2001 | Sullivan et al. | 60/285 |

* cited by examiner

*Primary Examiner*—Thomas Denion
*Assistant Examiner*—Diem Tran
(74) *Attorney, Agent, or Firm*—Allan J. Lippa; John D. Russell

(57) ABSTRACT

An air/fuel control system and method for controlling an air/fuel ratio entering an engine are disclosed. The system comprises a controller and two sensors. In operation, a first feedback loop is created around the engine to control the oxygen concentration in the exhaust gas. A second feedback loop is created around the engine and emission control device to adjust the air/fuel ratio. An emission control device model is used to modify the air/fuel ratio adjustment. A learned integral bias table, responsive to engine speed and engine load, is provided in the second feedback loop. Entries in the learned integral bias table are modified, one at a time, based upon integrated measurements of the downstream oxygen concentration made while the engine and catalyst are under stable operating conditions.

7 Claims, 6 Drawing Sheets

CATALYST BASED ADAPTIVE FUEL CONTROL

TECHNICAL FIELD

The present invention relates to the field of electronic engine control of internal combustion engines.

BACKGROUND OF THE INVENTION

Catalytic converters have the ability to reduce nitrogen oxides, and oxidize unburnt hydrocarbons and carbon monoxide that appear in the exhaust gas stream of internal combustion engines. The catalytic converter's efficiency at removing each pollutant is dependent upon, among other things, the concentration of oxygen present in the exhaust gas. The process that oxidizes unburnt hydrocarbons and carbon monoxides is more efficient when excessive oxygen is present in the exhaust gas. In other words, these two pollutants are readily cleaned by the catalyst when the air/fuel ratio entering the engine is lean. In contrast, the presence of excess oxygen in the catalyst inhibits the efficiency of the nitrogen oxide reduction process. Nitrogen oxides are more efficiently cleaned by the catalyst when the air/fuel ratio entering the engine is rich. Peak efficiency at removing all three pollutants simultaneously usually occurs at one specific air/fuel ratio, or within a small range of air/fuel ratios.

To provide the ideal oxygen concentration within the exhaust gas created by the engine, many engine control designs incorporate two feedback loops from the exhaust gas back to the air/fuel control mechanism. A first feedback loop is created by an air/fuel feedback control module and a first oxygen sensor that samples the oxygen concentration in the exhaust gas upstream from the catalyst. A second feedback loop is created by the air/fuel feedback control module and a second oxygen sensor that samples the oxygen concentration in the exhaust gas downstream from the catalyst. The first feedback loop provides rapid corrections to the air/fuel ratio entering the engine. The second feedback loop provides a bias back into the first feedback loop used to trim the air/fuel ratio to account for aging of the first oxygen sensor and the catalyst.

Difficulties arise in the air/fuel ratio control due to a decreased capability of the catalyst to store oxygen as it gets older. Control systems are often tuned for older catalysts and consequently are inefficient when the catalyst is new.

Several approaches have been taken to introduce a catalyst aging model to account for variations in oxygen storage capability over time. In general, these approaches have involved modifying the air/fuel ratio ramp/jump back waveform, or modifying the first feedback loop to account for the catalyst's oxygen storage capability as a function of catalyst age. For example, U.S. Pat. No. 5,848,528 issued to Liu on Dec. 15, 1998 discloses a catalyst aging method whereby a proportional gain that is dependent upon the catalyst's age is used in metering the amount of fuel sprayed into the engine.

Existing catalyst aging compensation methods, however, ignore the effects of the catalyst aging on the second feedback loop. Second feedback loops properly tuned for older catalysts are improperly tuned for newer catalysts, and vice versa. As the oxygen storage capacity of the catalyst decreases, it would be desirable to decrease the rate at which the second feedback loop trims the air/fuel ratio.

DISCLOSURE OF THE INVENTION

The present invention is an air/fuel control system and a method for controlling an air/fuel ratio entering an engine to maintain an oxygen concentration in the exhaust gas downstream from an emission control device at a predetermined value. The present invention includes adjusting the air/fuel ratio in response to a sensor that monitors the exhaust gas downstream from the emission control device. An emission control device model provides an indication of emission control device performance that is used to modify the adjustment to the air/fuel ratio.

The system includes another sensor that monitors the exhaust gas upstream from the emission control device, and a controller in communication with the sensors. The controller issues a command that controls the air/fuel ratio entering the engine. A first feedback loop is established by the upstream sensor and controller to control the air/fuel ratio entering the emission control device. A second feedback loop is created by the downstream sensor and controller to trim the first feedback loop to produce the predetermined oxygen concentration in the exhaust gas downstream from the emission control device.

An emission control device model is provided to modify the second feedback loop. The modification adjusts the feedback trim to account for modeled performances changes in the emission control device.

Engine speed and engine load dependencies may be accounted for by the inclusion of a set point table that controls a sensor set point reference voltage for the downstream sensor. As the engine speed and engine load change, the set point table outputs different sensor set point reference voltages to shift the effective output of the downstream sensor richer or leaner as appropriate.

A learned integral bias table may also be included in the second feedback loop to account for engine speed and engine load dependencies in the exhaust gas oxygen concentration. New entries in the learned integral bias table are inserted using a correction value generated by integrating the downstream sensor's output while the engine and emission control device are operating under stable conditions. This storage of learned integral bias table entries allows the system to learn and remember changes that occur in the combined characteristics of the sensors and emission control device over long time periods.

Accordingly, it is an object of the present invention to provide a method, and a system implementing the method, for controlling an air/fuel ratio entering an engine in response to a sensor monitoring an exhaust gas downstream from an emission control device, wherein an indication of emission control device performance is used to modify the air/fuel ratio adjustments due to the downstream sensor.

This and other objects will become more apparent from a reading of the detailed specification in conjunction with the drawings.

BEST MODE FOR CARRYING OUT THE INVENTION

Figure 1:
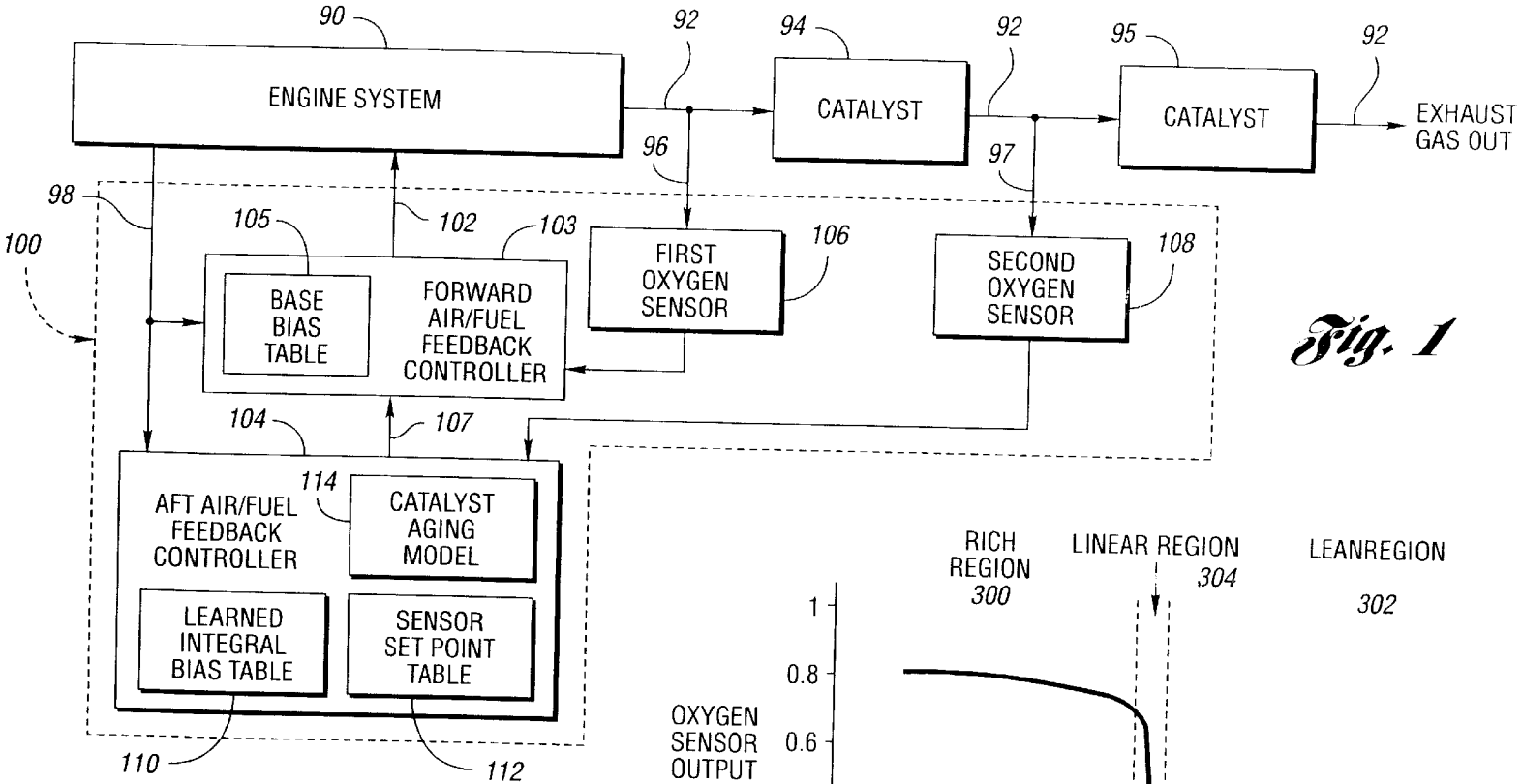
FIG. 1 is a block diagram of a system that implements the present invention.

A preferred embodiment of an air/fuel ratio control system 100 implementing the present invention is shown in FIG. 1. The air/fuel ratio control system 100 provides an air/fuel adjustment command 102 to an engine system 90. Engine system 90 uses the air/fuel adjustment command 102 to control the air/fuel ratio being utilized. An exhaust gas 92 created by the engine system 90 is directed through an emission control device, for example a catalyst 94 and an optional additional catalyst 95, after which it is discharged into the atmosphere.

In the preferred embodiment, the air/fuel ratio control system 100 includes a forward air/fuel feedback controller 103, an aft air/fuel feedback controller 104, a first oxygen sensor 106 (also referred to as an upstream sensor), and a second oxygen sensor 108 (also referred to as a downstream sensor). First oxygen sensor 106 is coupled to the exhaust gas 92 at a location upstream from the catalyst 94. Second oxygen sensor 108 is coupled to the exhaust gas 92 at a location downstream from the catalyst 94 and upstream from the additional catalyst 95. The first oxygen sensor 106 and second oxygen sensor 108 are electrically connected to the forward air/fuel feedback controller 103 and the aft air/fuel feedback controller 104, respectively. They monitor the exhaust gas 92 and communicate a first oxygen concentration signal for the first oxygen concentration 96 and a second oxygen concentration signal for the second oxygen concentration 97 respectively.

Forward air/fuel feedback controller 103 includes an optional base bias table 105 that is used to provide an engine speed and engine load dependent bias into a first feedback loop established by the first oxygen sensor 106 and the forward air/fuel feedback controller 103. The engine speed and engine load are provided to the base bias table 105 through additional data 98 provided by the engine system 90.

The aft air/fuel feedback controller 104 changes the air/fuel ratio through a trim value 107 that it provides to the forward air/fuel feedback controller 103. Forward air/fuel feedback controller 103 uses the trim value 107 to modify the air/fuel adjustment command 102 to raise and lower the mean air/fuel ratio being utilized without changing the modulation frequency of the air/fuel ratio.

Aft air/fuel feedback controller 104 also receives the additional data 98 from the engine system 90. Here, the additional data 98 includes engine speed, engine load, vehicle speed, coolant temperature, air/fuel ratio, ambient air temperature, manifold absolute pressure sensor status, diagnostic in-progress indications, purge flow condition, and the like. The aft air/fuel feedback controller 104 will use this additional data 98 in its calculations of when and how to command adjustments to the air/fuel ratio.

A learned integral bias table 110, a sensor set point table 112 and a catalyst aging model 114 are hosted by the aft air/fuel feedback controller 104. The learned integral bias table 110 is a lookup table containing one or more integral bias terms. These integral bias terms are used one at a time by the aft air/fuel feedback controller 104 in calculating the air/fuel adjust command 102. Selection of the proper integral bias term to use in the calculations is determined by the engine speed and engine load. The integral bias terms are variables and thus the learned integral bias table 110 must be stored in a nonvolatile or constantly powered form of memory.

The sensor set point table 112 is also a lookup table containing one or more sensor set point reference voltages. These sensor set point reference voltages are compared with the outputs from the second oxygen sensors 108 to determine when the air/fuel ratio is leaner or richer than wanted. Selection of the proper sensor set point reference voltage to use in the comparison is also determined by engine speed and engine load. The sensor set point reference voltages are usually predetermined constant values and thus the sensor set point table 112 is usually stored in a read only form of memory.

Variations on the sensor set point table 112 are allowed within the scope of the present invention. For example, the output of the sensor set point table 112 may be selected based upon only engine speed or only the engine load. In other examples, the sensor set point reference voltage may be a scalar or fixed value.

Catalyst aging model 114, or similar emission control device model, provides an indication of how efficiently the catalyst 94 operates. The aft air/fuel feedback controller 104 uses this indication to modify the air/fuel adjustment command 102 as the catalyst performance changes with age. The catalyst aging model 114 may be based upon time, mileage, temperature, or any other information known in the art for predicting or measuring catalyst efficiency aging.

In alternative embodiments of the present invention, one or both of the sensor set point table 112 and the catalyst aging model 114 may be disposed external to the aft air/fuel feedback controller 104.

In such embodiments, the set point table 112 and catalyst aging model 114 are coupled to the aft air/fuel feedback controller 104 to send and receive information.

Figure 2:
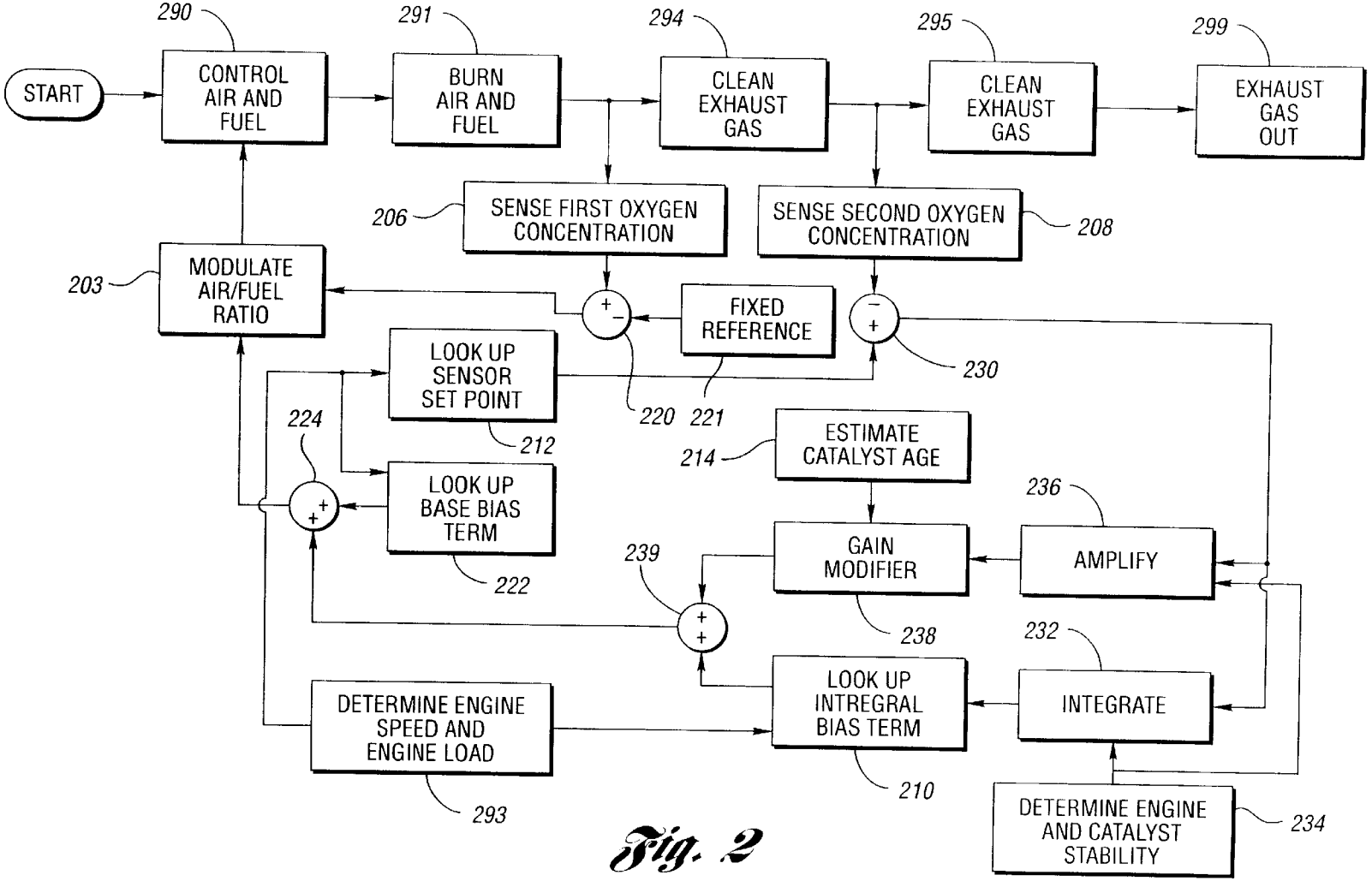
FIG. 2 is a functional block diagram of a method that implements the present invention.

FIG. 2 is a flow diagram showing a method of operation that implements the present invention. Referring to FIG. 1 and FIG. 2, operations start with control by the engine system 90 of the air and fuel entering the engine system 90, as shown in block 290.

The ratio of air to fuel is normally modulated by a modulate air/fuel ratio function 203 in the forward air/fuel feedback controller 103. The objective of the modulation is to produce a desired time-average oxygen concentration leaving the engine system 90 and entering catalyst 94. In the preferred embodiment, the modulation is in the form of a ramp and jump scheme. Other modulation schemes may also be employed. The desired time-average oxygen concentration is chosen to create maximum emission cleaning efficiency within catalyst 94.

Air and fuel entering the engine system 90 are then burned during a combustion stroke of the engine system 90, as shown in block 291, resulting in the exhaust gas 92 as a byproduct.

Exhaust gas 92 flows out from the engine system 90 through the catalyst 94 and the additional catalyst 95. Oxides of nitrogen, hydrocarbons and carbon monoxides are cleaned from the exhaust gas 92 as it flows through catalysts 94 and 95, as shown in blocks 294 and 295 respectfully. When the exhaust gas 92 flowing into the catalyst 94 has the desired time-average oxygen concentration, then the exhaust gas 92 leaving the catalyst 94 should meet emissions requirements with roughly a predetermined oxygen concentration remaining in the exhaust gas. After flowing through the additional catalyst 95, the exhaust gas 92 continues to flow downstream until it is ultimately discharged into the atmosphere, as shown in block 299.

Figure 3:
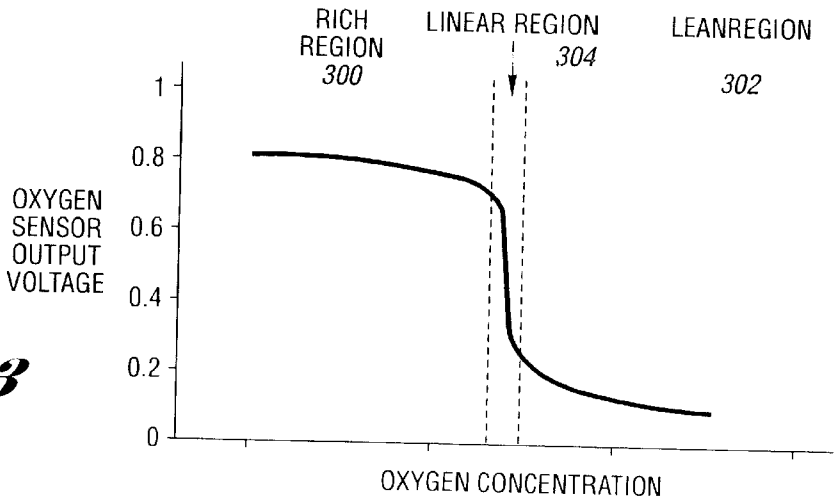
FIG. 3 is a plot of an oxygen sensor output voltage as a function of an air/fuel ratio.

First oxygen sensor 106 samples the first oxygen concentration 96 of the exhaust gas 92 at a location between the engine system 90 and catalyst 94, as shown in block 206. FIG. 3 is a graph showing the output voltage of a common oxygen sensor as a function of oxygen concentration. When the air/fuel ratio entering the engine system 90 is rich, practically all of the oxygen is consumed in a combustion stroke within engine system 90 leaving a very low oxygen concentration in the exhaust gas 92. At low oxygen concentrations, the typical oxygen sensor outputs a voltage near 0.8 volts, as shown in rich region 300. A lean air/fuel ratio entering the engine system 90 results in a low output voltage in the oxygen sensor of typically around 0.2 volts, as shown in lean region 302. Note that in both the rich region 300 and lean region 302, the output voltage is only slightly dependent upon the actual oxygen concentration. Between the rich region 300 and lean region 302, the oxygen sensor output transitions through a linear region 304. In the linear region 304, small changes in the oxygen concentration result in significant changes in the oxygen sensor output voltage.

Referring again to FIG. 1 and FIG. 2, the output voltage from the first oxygen sensor 106 representing the first oxygen concentration signal is then provided to the forward air/fuel feedback controller 103. Forward air/fuel feedback controller 103 then compares this voltage, as shown in block 220, with a fixed reference voltage 221 to create a switching signal. The switching signal has one polarity when the upstream oxygen concentration signal is low, and the opposite polarity when the upstream oxygen concentration signal is high. The switching signal is then communicated back to the modulate air/fuel ratio function 203 completing a first feedback loop. The engine system 90 then uses this feedback to adjust the air/fuel ratio to achieve the desired oxygen concentration in the exhaust gas 92.

The air/fuel ratio required to produce the desired oxygen concentration in the exhaust gas 92 varies with changing operating conditions in the engine system 90. Two important factors that influence the air/fuel ratio are the engine speed, and an engine load or torque that the engine system 90 must produce. Engine speed and engine load are determined by the engine system 90, as shown in block 293, and communicated to the forward air/fuel feedback controller 103 and the aft air/fuel feedback controller 104.

Forward air/fuel feedback controller 103 applies the engine speed and engine load to the base bias table 105. Base bias table 105 then looks up a base bias term, as shown in block 222. Base bias term is then provided to the modulate air/fuel ratio function 203 through summing function 224.

The aft air/fuel feedback controller 104 applies the engine speed and engine load as inputs for the learned integral bias table 110.

Initial entries in the learned integral bias table 110 are set to provide the desired time-average oxygen concentration entering the catalyst 94 under an assumption that the catalyst 94 is new. Learned integral bias table 110 responds to the inputs by looking up a selected integral bias term, as shown in block 210. This selected integral bias term is then summed with the base bias term, as shown in block 224, prior to being provided to the control air and fuel function, block 290.

Information regarding changes in the engine speed and engine load may also be used to adjust the offset applied to the output from the second oxygen sensor 108 to account for subsequent changes in the exhaust gas 92. Engine speed and engine load may be used as inputs into the sensor set point table 112 to look up a selected sensor set point reference voltage, as shown in block 212.

Second oxygen sensor 108 samples the downstream oxygen concentration 97 of the exhaust gas 92 at a location downstream from the catalyst 94, as shown in block 208. The output voltage from the second oxygen sensor 108 is then adjusted by subtracted it from the selected sensor set point reference voltage, as shown in block 230, thereby creating a downstream oxygen concentration error signal.

The downstream oxygen concentration error signal is integrated while the engine system 90 and catalyst 94 are being operated under stable conditions, as shown in block 232. Output from the integration function 232 is a correction value that is provided to the learned integral bias table 110. The integral bias term lookup function 210 uses the correction value to modify the selected integral bias term currently being supplied to the summing function 224. The flow of information just described creates a second feedback loop from behind the catalyst 94, through the second oxygen sensor 108, the learned integral bias table 110 and back to the front of the engine system 90. This second feedback loop modifies the time-average air/fuel ratio entering the engine system 90 to drive the downstream oxygen concentration 97 to match the predetermined oxygen concentration. In operation, the second feedback loop accounts for changes in the performance of the first oxygen sensor 106, changes in the performance of the catalyst 94, and any other factors that cause the downstream oxygen concentration 97 to deviate away from the predetermined oxygen concentration. Routing the second feedback loop through the learned integral bias table 110 allows the air/fuel ratio control system 100 to learn, update and remember a different integration bias term for each pairing of engine speed and engine load represented in the learned integral bias table 110.

Generation of the correction value from the integration function 232 must only be conducted when the engine system 90 and catalyst 94 are operating under stable conditions. Stable operating conditions allow feedback information from the second oxygen sensor 108 to propagate through the engine system 90 and catalyst 94 and back to the second oxygen sensor 108 allowing for capture of the proper time-average air/fuel ratio. When the operating condition of the engine system 90 and/or catalyst 94 are changing rapidly, then the feedback initiated by the second oxygen sensor 108 is skewed in time from the current operating conditions, and thus may be inappropriate.

Under changing operating conditions, the air/fuel ratio control system 100 cannot differentiate between the changing operating conditions and slow performance changes in the first oxygen sensor 106 and catalyst 94.

In the preferred embodiment, responsibility for determining when the engine system 90 and catalyst 94 are stable, as shown in block 234, is allocated to the aft air/fuel feedback controller 104. Typically, the temperature of the coolant (not shown) used in the engine system 90 is measured to detect when the engine system 90 has completed a warmup and is thermally stable. Other factors such as time since starting may also be used in determining stability. Likewise, thermal stability of the catalyst 94 may be determined by a temperature sensor (not shown) embedded in the catalyst, by time since starting the engine system 90, by a combination of exhaust gas temperature and time, by air mass speed flowing through the catalyst 94, air/fuel ratio, ambient air temperature, or the like.

Other parameters that may be considered include time variations in the engine speed and engine load, an engine speed above a predetermined threshold, low purge flow in the engine system 90, a healthy diagnostic status for an air pressure sensor measuring the air flow into the engine system 90, a healthy diagnostic status for the first oxygen sensor 106, the absence of any intrusive diagnostic test being performed on the engine system 90 or catalyst 94, and other similar situations.

The preferred embodiment of the present invention includes a proportional bias term in the second feedback loop. The proportional bias term is generated by amplifying the downstream oxygen concentration error signal, as shown in block 236, when the engine system 90 and catalyst 94 are stable. Next, the proportional bias term is modified by a gain modifier function, as shown in block 238. Gain modifier function 238 is controlled by an efficiency signal generated by a catalyst age estimating function, block 214, performed by the catalyst aging model 114. From the gain modifier function 238, the proportional bias term is added, block 239, to the selected integral bias term provided by the integral bias lookup function 210 before being added, block 224, with the base bias term.

The proportional bias term provides beneficial characteristics to the air/fuel ratio control system 100. First, it increases the rate at which the second feedback loop drives the downstream oxygen concentration back to the predetermined oxygen concentration. This allows the air/fuel ratio control system 100 to recover from conditions resulting in oxygen concentration transients in the exhaust gas 92. It has also been shown that the proportional bias term in the second feedback loop may be used to reduce or eliminate erratic low frequency oscillations that may sometimes occur in the air/fuel ratio.

The gain modifier function 238, as controlled by the catalyst age estimating function 214, permits the gain of the proportional bias term to track changes in the catalyst 94 over long time periods. When catalyst 94 is young, the catalyst age estimating function 214 instructs the gain modifier function 238 to provide a high gain for the proportional bias term. As the catalyst 94 gets older, its ability to dampen fluctuations in the oxygen concentration in the exhaust gas 92 decreases. In response to this decrease, the catalyst age estimating function 214 instructs the gain modifier function 238 to lower the gain applied to the proportional bias term. The lower gain in the second feedback loop reduces the possibility of creating large oscillations in the air/fuel ratio.

Figure 4:
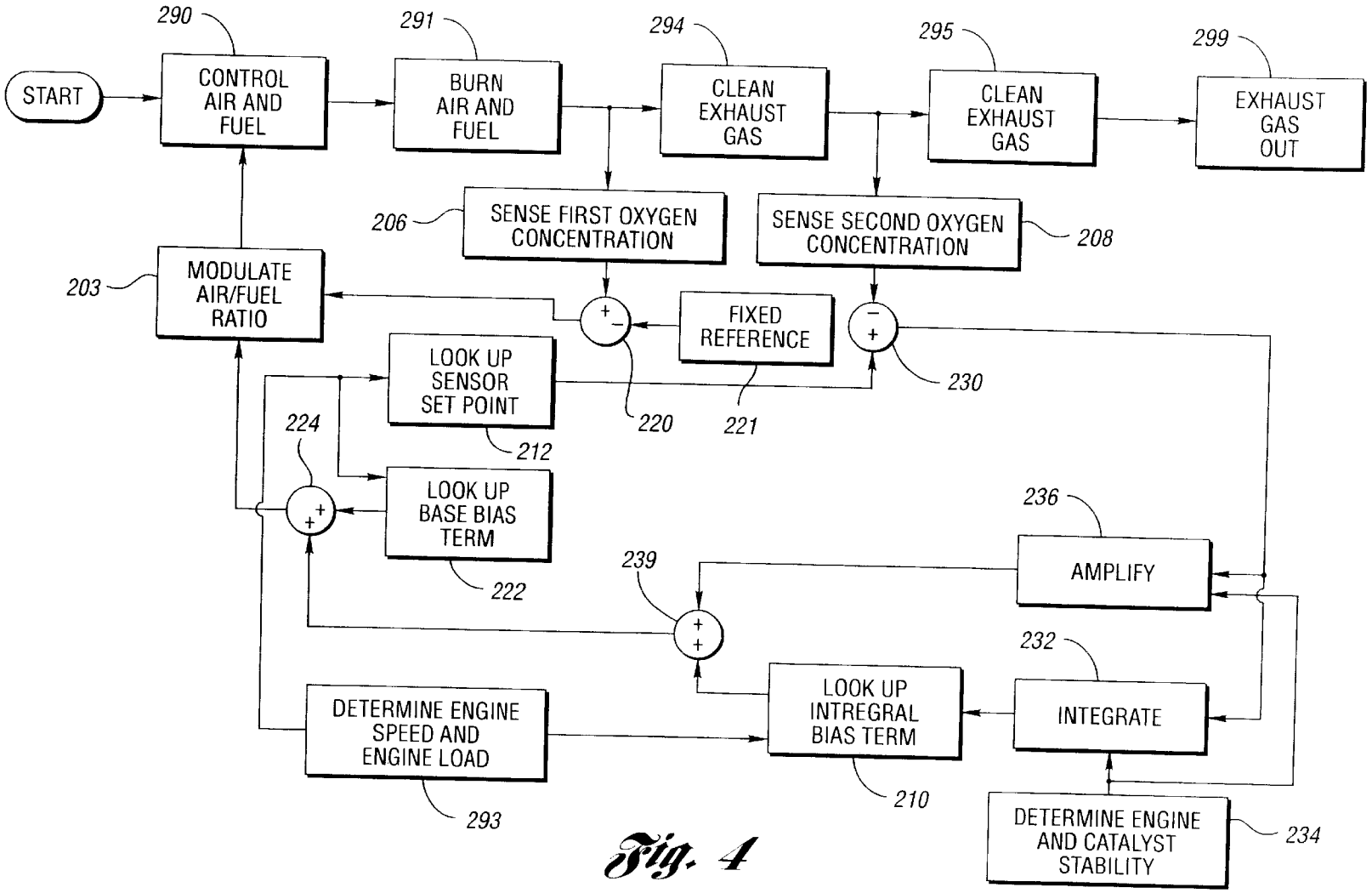
FIG. 4 is a functional block diagram of a first alternative embodiment of the method.

Referring to FIG. 4, alternative embodiments of the present invention may be created without the gain modifier function 238 and the catalyst age estimating function 214. In such embodiments, the amplification function 236 is arranged to operate with an old catalyst 94. Output from the amplifying function 236 is coupled directly into the summing function 239.

Figure 5:
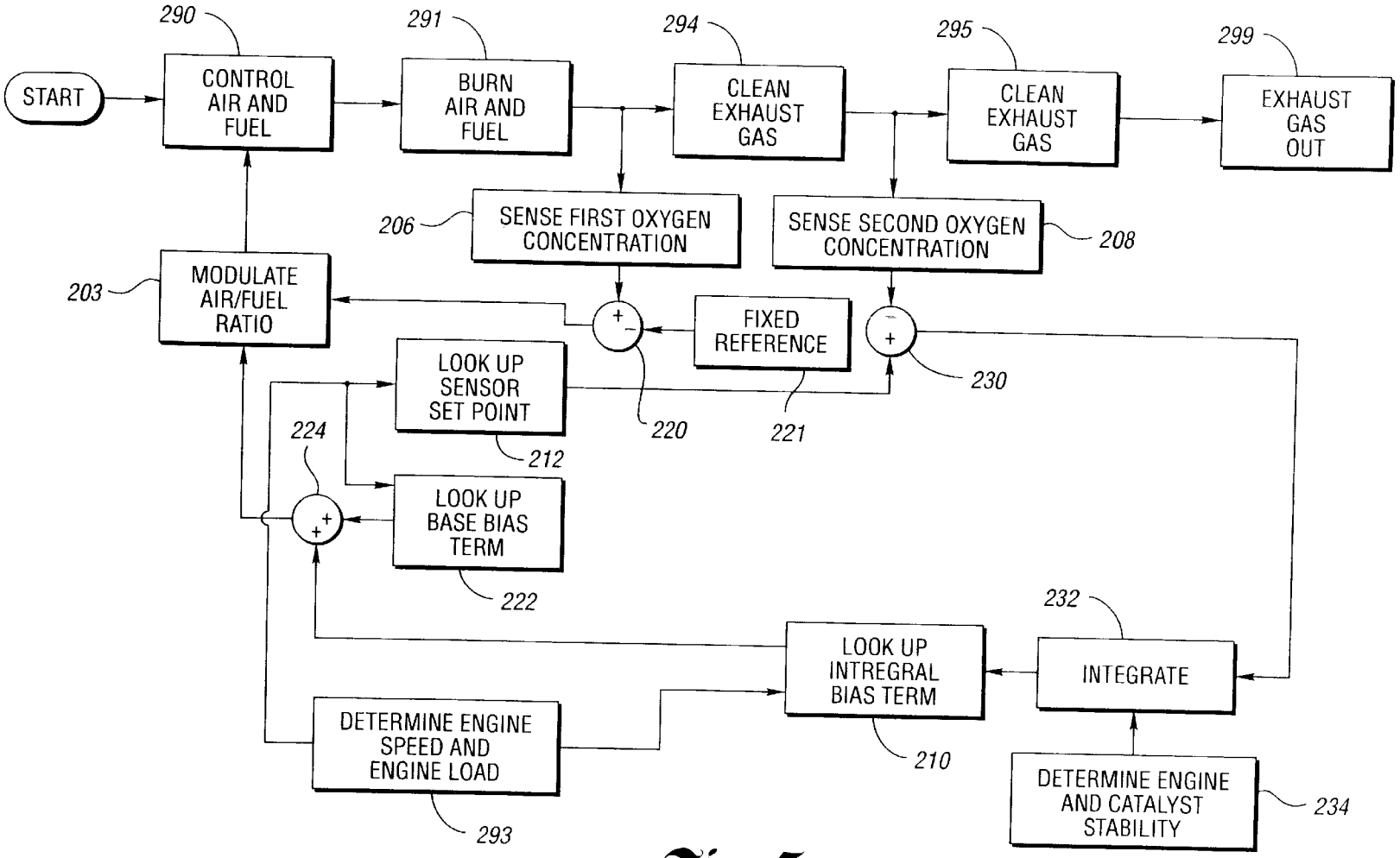
FIG. 5 is a functional block diagram of a second alternative embodiment of the method.

Referring to FIG. 5, other alternative embodiments may be created without the gain modifier function 238, catalyst age estimating function 214 and amplification function 236. Here, the second feedback loop is governed by the integration function 232 applied to the offset downstream oxygen concentration.

Figure 6:
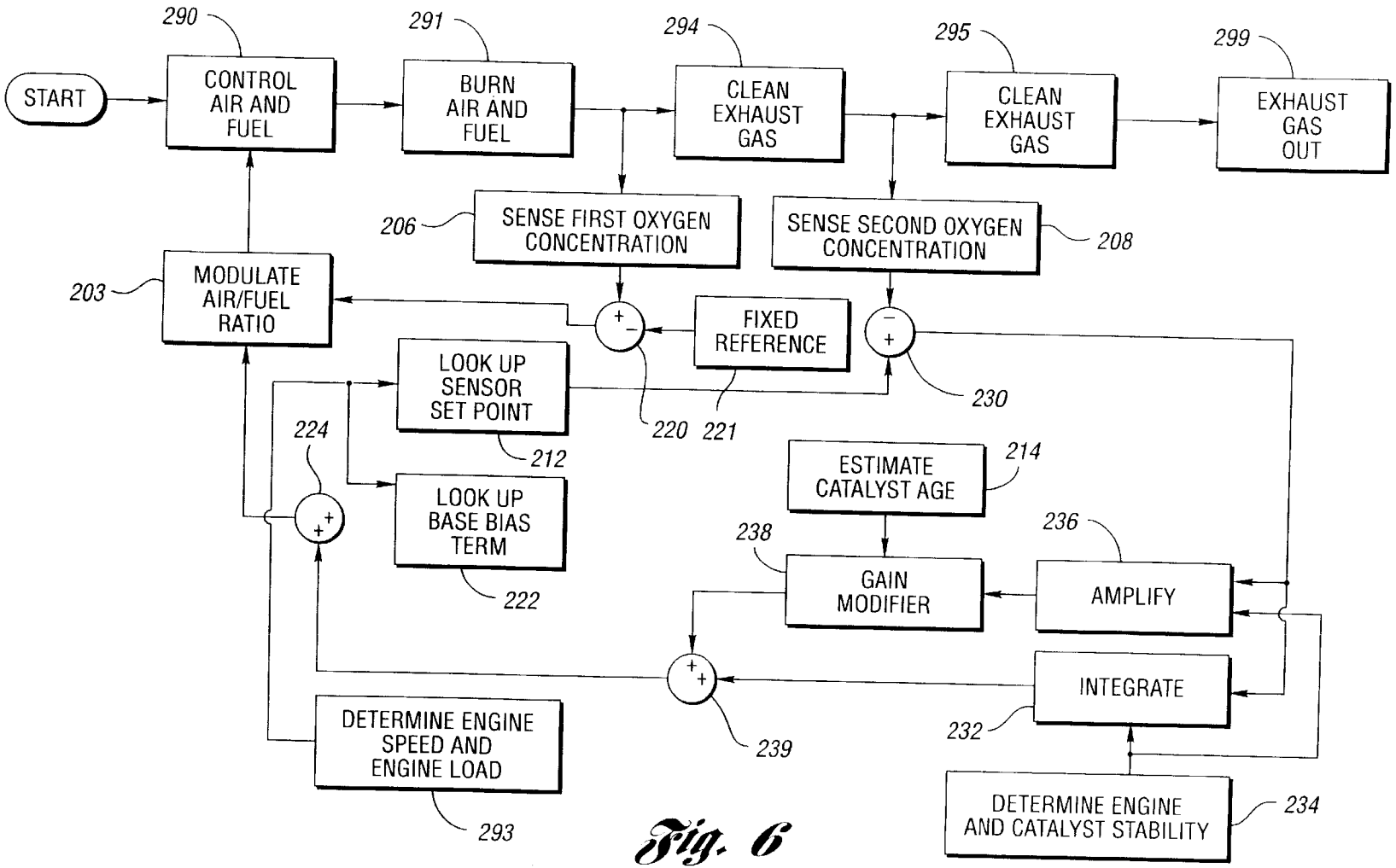
FIG. 6 is a functional block diagram of a third alternative embodiment of the method.

Referring to FIG. 6, in yet another alternative embodiment, the integral bias term lookup function 210 may be eliminated. Here, the correction value created by the integrating function 232 is used as the integral bias term. The integral bias term output from the integrating function 232 is provided directly to the summing function 239 where it is added to the proportional bias term. Now, every time that the engine system 90 or catalyst 94 change operation conditions, the integrating function 232 and amplifying function 236 must establish a new trim to be feed into the first feedback loop.

In other alternative embodiments, the look up base bias term function 222 may be changed to operate from only one of the engine speed or engine load values. The function 222 may also be set to a fixed value, or even eliminated.

Figure 7:
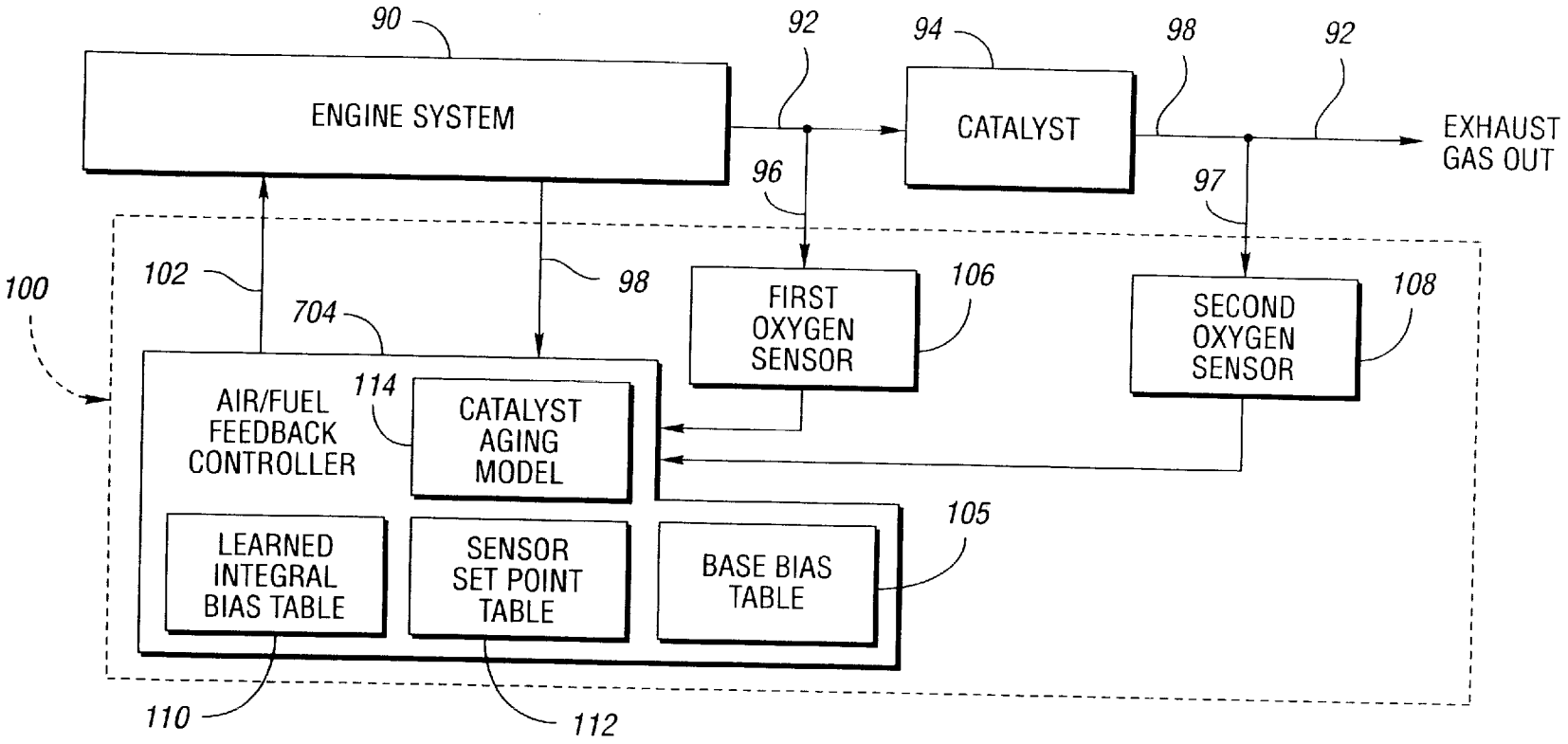
FIG. 7 is a block diagram of a second alternative embodiment of the system.

Referring to FIG. 7, the forward air/fuel feedback controller 103 and aft air/fuel feedback controller 104 may be combined into a single air/fuel feedback controller 704. This one controller 704 performs the same functions as the forward and aft controllers 103–104 in the single electronics package.

FIG. 7 also shows other alternative embodiments where the second oxygen sensor 108 may be located at a position downstream from the additional catalyst 95 (i.e., additional catalyst 95 is merged into catalyst 94), or the additional catalyst 95 may be eliminated. When the second oxygen sensor 108 is positioned upstream from the additional catalyst 95, the additional catalyst 95 can suppress excursions in the exhaust gas 92 away from ideal before the exhaust gas 92 is vented into the atmosphere.

As an example, consider a case where the air/fuel ratio becomes sufficiently lean to cause excessive nitrogen oxides and oxygen to appear at the second oxygen sensor 108. Here, the additional catalyst 95 can complete the reduction process on the excess nitrogen oxides and store the excess oxygen while the second feedback loop trims the air/fuel ratio to a richer condition.

In an opposing example, the air/fuel ratio may become sufficiently rich to cause excessive hydrocarbons and carbon monoxide to appear at the second oxygen sensor 108. Now, the additional catalyst 95 completes the oxidation of the excess hydrocarbons and excess carbon monoxide using previously stored oxygen while the second feedback loop leans the air/fuel ratio.

While the best modes for carrying out the invention have been described in detail, those familiar with the art to which this invention relates will recognize various alternative designs and embodiments for practicing the invention as defined by the following claims.

What is claimed is:

1. A method for controlling an air/fuel ratio entering an engine in response to an oxygen sensor that monitors an exhaust gas downstream from an emission control device, the method comprising:

adjusting the air/fuel ratio in response to the downstream oxygen sensor, wherein the adjusting is responsive to a selected integral bias term of a plurality of integral bias terms;

providing an indication of emission control device performance;

modifying the air/fuel ratio adjustment in response to the indication of emission control device performance, wherein modifying includes adjusting a proportional feedback gain based on the indication of emission control device performance;

choosing the selected integral bias term from the plurality of integral bias terms in response to an engine speed and an engine load;

calculating a correction value in response to the downstream oxygen sensor; and modifying the selected integral bias term with the correction value to compensate for variations in the exhaust gas downstream from the emission control device.

2. The method of claim 1, further comprising adjusting a sensor set point for the sensor in response to the engine speed and the engine load.

3. A method of controlling an air/fuel ratio entering an engine in response to an oxygen sensor that monitors an exhaust gas downstream from an emission control device, the method comprising:

choosing a selected integral bias term from a plurality of integral bias terms in response to an engine speed and an engine load;

adjusting the air/fuel ratio in response to the selected integral bias term;

determining when the engine and the emission control device are stable;

calculating a correction value in response to the downstream oxygen sensor while the engine and the emission control device are stable;

modifying the selected integral bias term with the correction value to compensate for variations in the exhaust gas downstream from the emission control device, wherein modifying includes adjusting a proportional feedback gain based on the indication of emission control device performance;

providing an indication of emission control device performance; and modifying the air/fuel ratio adjustment in response to the indication of emission control device performance.

4. An air/fuel control system for use with an engine and an emission control device, the system comprising:

an oxygen sensor disposed downstream from the emission control device and operative to monitor an exhaust gas;

an emission control device model operative to generate an indication of emission control device performance;

a learned integral bias table in communication with the controller and the engine, the learned integral bias table having a plurality of cells each having an integral bias term modified based on the downstream oxygen sensor, the learned integral bias table being operative to produce a selected integral bias term from a selected cell of the plurality of cells in response to an engine speed and an engine load; and a controller in communication with the sensor, the emission control device model, and the engine, the controller being operative to adjust an air/fuel ratio entering the engine in response to the downstream oxygen sensor, and to modify the air/fuel ratio adjustment in response to the indication of emission control device performance by adjusting a proportional feedback gain based on the indication of emission control device performance, the controller being further operative to modify the air/fuel ratio in response to the selected integral bias term.

5. The air/fuel control system of claim 4, further comprising another emission control device dispose downstream from the sensor.

6. An air/fuel control system for use with an engine and an emission control device, the system comprising:

an oxygen sensor disposed downstream from the emission control device and operative to monitor an exhaust gas;

a learned integral bias table in communication with the engine, the learned integral bias table having a plurality of cells each having an integral bias term based on the downstream oxygen sensor, the learned integral bias table being operative to produce a selected integral bias term from a selected cell of the plurality of cells in response to an engine speed and an engine load;

a controller in communication with the downstream oxygen sensor, the learned integral bias table, and the engine, the controller being operative to adjust an air/fuel ratio entering the engine in response to the selected integral bias term, to determine when the engine and the emission control device are stable, and to modify the selected integral bias term in response to the downstream oxygen sensor while the engine and the emission control device are stable;

an emission control device model operative to generate an indication of emission control device performance; and the controller being further operative to modify the air/fuel ratio adjustment in response to the indication of emission control device performance, wherein modifying the air/fuel ratio adjustment in response to the indication of emission control device performance includes adjusting a proportional feedback gain based on the indication of emission control device performance.

7. The air/fuel control system of claim 6, further comprising another emission control device disposed downstream from the sensor.

* * * * *